US010354768B2

(12) United States Patent
Karlen et al.

(10) Patent No.: US 10,354,768 B2
(45) Date of Patent: Jul. 16, 2019

(54) RADIOGRAPHIC AND COMPUTED TOMOGRAPHY INSPECTION ANTI-COUNTERFEIT SECURITY

(71) Applicant: Hamilton Sundstrand Corporation, Charlotte, NC (US)

(72) Inventors: Eric Karlen, Rockford, IL (US); William Louis Wentland, Rockford, IL (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 15/402,577

(22) Filed: Jan. 10, 2017

(65) Prior Publication Data

US 2018/0197645 A1 Jul. 12, 2018

(51) Int. Cl.
*G21F 3/00* (2006.01)
*G21F 1/08* (2006.01)

(52) U.S. Cl.
CPC . *G21F 3/00* (2013.01); *G21F 1/08* (2013.01)

(58) Field of Classification Search
CPC ..... G21F 1/00; G21F 1/02; G21F 1/04; G21F 1/042; G21F 1/06; G21F 1/08; G21F 1/12
USPC ..... 250/505.1, 506.1, 515.1, 517.1, 518.1, 250/519.1
See application file for complete search history.

(56) References Cited

U.S. PATENT DOCUMENTS

| | | | | |
|---|---|---|---|---|
| 7,893,413 | B1 * | 2/2011 | Appleby | B29C 33/302 250/505.1 |
| 8,084,855 | B2 | 12/2011 | Lower et al. | |
| 8,344,485 | B1 | 1/2013 | Lee | |
| 8,428,216 | B2 | 4/2013 | Dennerlein et al. | |
| 8,871,310 | B2 | 10/2014 | Hyeon et al. | |
| 2002/0179860 | A1 * | 12/2002 | Smith | G21F 1/106 250/515.1 |
| 2011/0291032 | A1 * | 12/2011 | Sun | H01B 1/22 250/515.1 |
| 2012/0085925 | A1 * | 4/2012 | Kasuya | B82Y 10/00 250/453.11 |
| 2014/0091241 | A1 * | 4/2014 | Rabiei | B22F 3/1112 250/518.1 |
| 2014/0284503 | A1 * | 9/2014 | Stevick | C22C 45/10 250/515.1 |
| 2016/0203594 | A1 | 7/2016 | Morard et al. | |

(Continued)

FOREIGN PATENT DOCUMENTS

| | | | |
|---|---|---|---|
| CN | 203720109 | U | 7/2014 |
| WO | 2015077471 | A1 | 5/2015 |
| WO | 2016073571 | A2 | 5/2016 |

*Primary Examiner* — Jason L McCormack
(74) *Attorney, Agent, or Firm* — Cantor Colburn LLP

(57) ABSTRACT

A structure for preventing a scan by a beam is provided. The structure includes a primary material forming the structure. The primary material includes a first mass attenuation coefficient enabling the primary material to be penetrated by the beam. The structure also includes a matrix of dense particles within the primary material. The dense particles include secondary materials different than the primary material. The secondary materials comprise a subsequent mass attenuation coefficient that is greater than the first mass attenuation coefficient of the primary material. The subsequent mass attenuation coefficient enables the dense particles to attenuate the beam to distort the scan.

7 Claims, 6 Drawing Sheets

(56) References Cited

U.S. PATENT DOCUMENTS

| | | | |
|---|---|---|---|
| 2016/0229120 | A1 | 8/2016 | Levine et al. |
| 2016/0327660 | A1 | 11/2016 | Harding |

* cited by examiner

RADIOGRAPHIC AND COMPUTED TOMOGRAPHY INSPECTION ANTI-COUNTERFEIT SECURITY

BACKGROUND

With respect to manufacturing integrated systems and solutions, along with components, parts, and tools therein, there is a risk in production (and for aftermarket components) of counterfeit parts entering the supply chain. Counterfeit parts are produced from reverse engineering methods. As the reverse engineering methods make technology advancements, protecting sensitive intellectual property related to the integrated systems and solutions, along with components, parts, and tools therein, is in greater need.

BRIEF DESCRIPTION

In accordance with one or more embodiments, a structure is provided. The structure includes a primary material forming the structure. The primary material includes a first mass attenuation coefficient enabling the primary material to be penetrated by the beam. The structure also includes a matrix of dense particles within the primary material. The dense particles include secondary materials different than the primary material. The secondary materials comprise a subsequent mass attenuation coefficient that is greater than the first mass attenuation coefficient of the primary material. The subsequent mass attenuation coefficient enables the dense particles to attenuate the beam to distort the scan.

In accordance with one or more embodiment or the structure embodiment above, the primary material can comprise aluminum and the one or more secondary materials can comprise tungsten, copper, nickel, or iron.

In accordance with one or more embodiment or any of the structure embodiments above, the one or more secondary materials can comprise crystal particles.

In accordance with one or more embodiment or any of the structure embodiments above, the one or more secondary materials can comprise round spheres.

In accordance with one or more embodiment or any of the structure embodiments above, the one or more secondary materials can comprise oblong shapes.

In accordance with one or more embodiment or any of the structure embodiments above, the matrix of dense particles can be uniform.

In accordance with one or more embodiment or any of the structure embodiments above, the matrix of dense particles can comprise one or more secondary materials located in offset positions.

In accordance with one or more embodiment or any of the structure embodiments above, the matrix of dense particles can comprise one or more secondary materials located in at least one cluster implemented to distort a view of a design feature to the structure.

In accordance with one or more embodiment or any of the structure embodiments above, the matrix of dense particles can comprise one or more vacant areas that include no dense particles to reveal a view of a design feature to the structure.

In accordance with one or more embodiment or any of the structure embodiments above, the matrix of dense particles can comprise one or more vacant areas that include no dense particles to mislead a scan and analysis.

In accordance with one or more embodiment or any of the structure embodiments above, the matrix of dense particles can comprise one or more gaps to enable geometric dimensioning and tolerancing measurements and inspection of critical areas of the structure.

In accordance with one or more embodiment or any of the structure embodiments above, the structure can comprise a component, a part, or a tool utilized in an electro-mechanical system of an aircraft.

In accordance with one or more embodiment or any of the structure embodiments above, the primary material can be layered via additive manufacturing technologies to form the structure.

In accordance with one or more embodiment or any of the structure embodiments above, the primary material can be produced via casting technologies to form the structure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Embodiments herein relate to a network or matrix of dense particles within a structure of a sample that deter or prevent x-ray and computed tomography being used to copy the structure through reverse engineering and/or that aid in inspection and identification of the structure. The sample can be a component, a part, and/or a tool utilized in a larger system, such as an electro-mechanical system of an aircraft. The technical effects and benefits of the network or matrix of dense particle embodiments include increased confidence in security of structure design, reduced risk of counterfeit parts entering the supply chain and strengthening of a base material of the structure.

Figure 1:
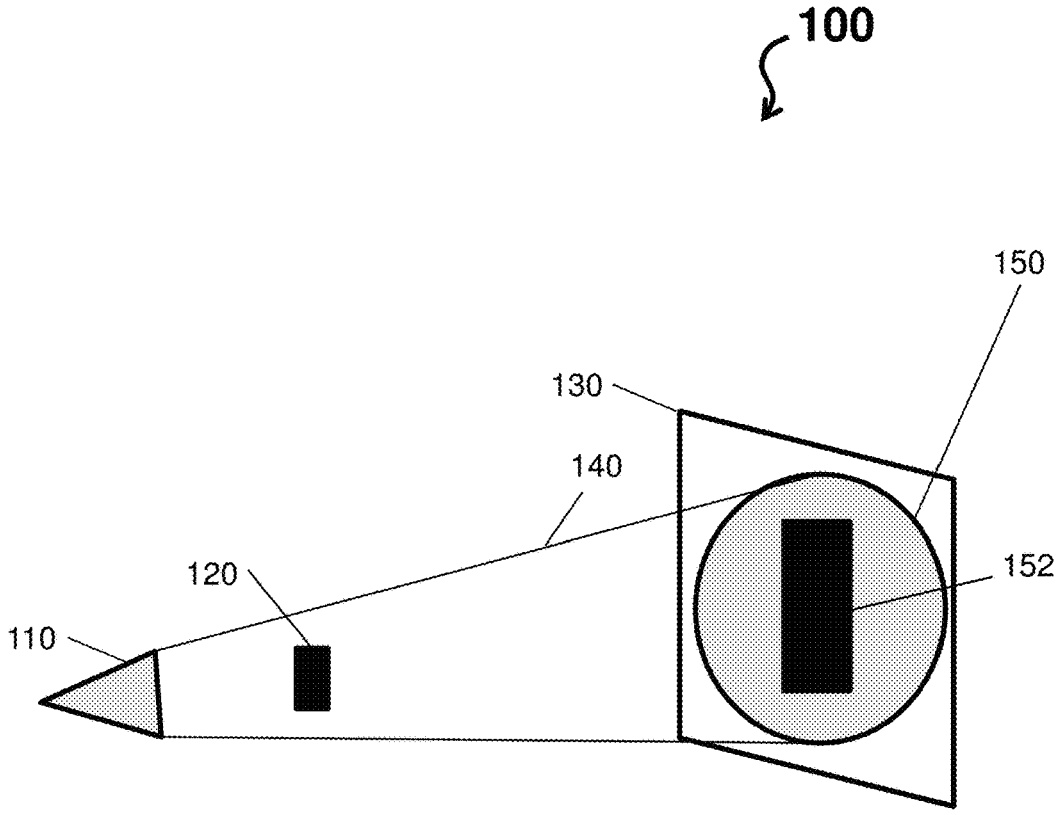
FIG. 1 depicts a beam detection system in accordance with one or more embodiments.

Turning now to FIG. 1, a beam detection system 100 is depicted according to one or more embodiments. As shown in FIG. 1, the beam detection system 100 includes a beam source 110, a sample 120, and a detector 130, along with a beam 140 and an image 150. The beam detection system 100 can be an imaging system and process that creates visual representations of an interior of the sample 120 for analysis. The analysis can support protection from reverse engineering and/or identification of the sample 120. Example types of the beam detection system 100 include X-ray radiography, magnetic resonance imaging, ultrasound imaging, tactile imaging, thermography, etc.

In operation, the beam source 110 projects the beam 140 across the sample 120 so that the detector 130 receives the image 150. For example, the beam source 110 projects, as the beam 140, one or more radio waves (or other medium) according to a type of beam detection system 100. The sample 120 can be on and rotated by a turn-table so that multiple images 150 are captured as the sample 120 spins. The detector 130 receives the image 150, which includes an imaged interior 152 of the sample 120. In a non-limiting embodiment, a computed tomography inspection using a highly collimated fan beam and collimated linear diode array (e.g., beam 140) would penetrate the structure 120 unabated to perform geometric dimensioning and tolerancing measurements and inspection of critical areas of the structure 120.

The imaged interior 152 can detail a structure of the sample 120. The structure of the sample 120 can be produced and manufactured through additive manufacturing technologies. Additive manufacturing technologies can build the sample 120 by adding layer-upon-layer of primary materials, whether the material is plastic, metal, etc. In an alternative embodiment, the structure of the sample 120 can be produced and manufactured through casting. Thus, the primary material is layered via additive manufacturing technologies to form the structure itself. However, if the structure of the sample 120 includes a network or a matrix of dense particles, then the structure the sample 120 inherently deters or prevents the beam detection system 100 from being used to copy the sample 120. Additive manufacturing technologies can include the network or the matrix of dense particles into the sample 120 by adding secondary materials that are different from the primary materials.

The dense particles can comprise any material with a greater mass attenuation coefficient than the primary material surrounding the matrix would also work. The mass attenuation coefficient characterizes how easily material can be penetrated by the beam 140. A large attenuation coefficient quickly "attenuates" (weakens) the beam as it passes through the material, thereby distorting the image 150. A small attenuation coefficient allows the material to be relatively transparent to the beam 150. For instance, with respect to a dense particle or material within a less dense primary material, the denser particle causes significant attenuation of an x-ray creating noise in the image 150. In a non-limiting embodiment, if the primary material is aluminum, the dense particles can include be one or more of tungsten, copper, nickel, and iron. In a non-limiting embodiment, the dense particles can be crystal particles, such as a Lutetium Aluminum Garnet crystal material, that can provide a diffraction pattern. The network or the matrix of dense particles is further described with respect to FIGS. 2-6.

Figure 2:
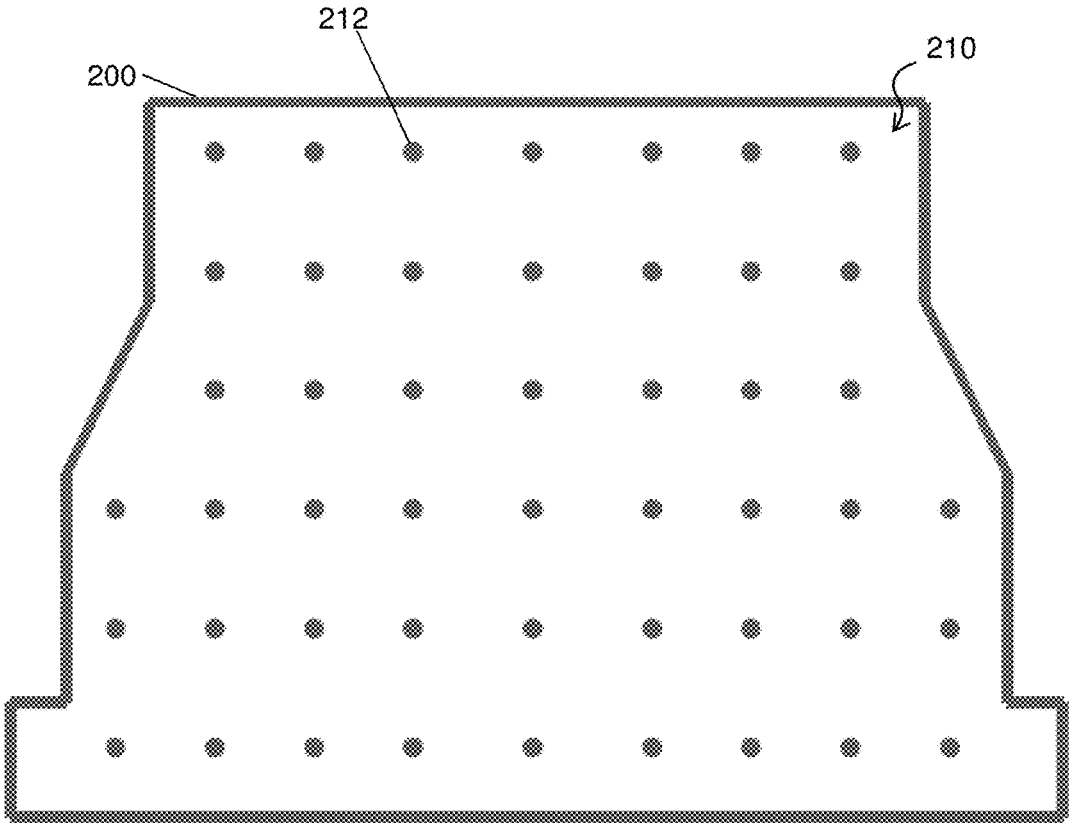
FIG. 2 depicts a uniform matrix of dense materials in a structure in accordance with one or more embodiments.

FIG. 2 depicts a structure 200 comprising a uniform matrix of dense materials 210 in accordance with one or more embodiments. The uniform matrix of dense materials 210 is an example of the network or the matrix of dense particles. The uniform matrix of dense materials 210 includes a plurality of crystal particles 212 distributed in three-dimensional grid, each of which causes scattering of the beam 140 during operations of the beam detection system 100. In this way, a reconstructed volume based on a plurality of imaged interiors 152 of the structure 200 would contain a significant amount of noise (e.g., due to the scattering) that would not easily be evaluated or reverse engineered. Note that the plurality of crystal particles 212 can be discrete round spheres according to one or more embodiments. Also, in a non-limiting embodiment, the structure of the structure 200 can be produced and manufactured through casting, thereby providing the dense particles in a non-uniform distribution within the structure 200.

Figure 3:
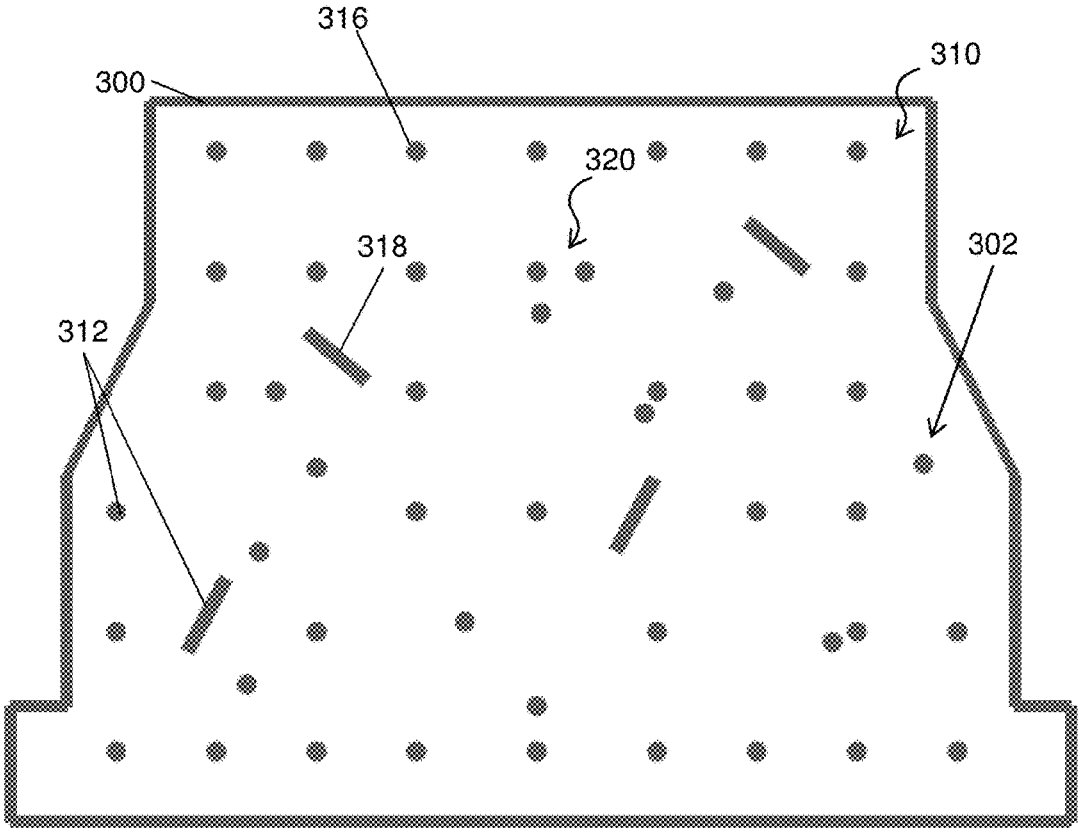
FIG. 3 depicts a modified matrix of dense materials including offset positions in a structure in accordance with one or more embodiments.

FIG. 3 depicts a structure 300 comprising a modified matrix of dense materials 310 including offset positions 302 in accordance with one or more embodiments. The modified matrix of dense materials 310 is an example of the network or the matrix of dense particles as a randomized matrix. The modified matrix of dense materials 310 includes a plurality of crystal particles 312 distributed in three-dimensional grid, each of which causes scattering of the beam 140 during operations of the beam detection system 100. A portion of the modified matrix of dense materials 310 is located in offset positions, as shown by crystal particle 302. Note that the plurality of crystal particles 312 can be discrete round spheres, as shown by crystal particle 316, or have oblong shapes, as identified by crystal particle 318, according to one or more embodiments. Grouping of particles, as identified by crystal particle 320, can actually enhance or create greater noise and scattering within the image 150. The technical effects and benefits of the modified matrix of dense materials 310 include preventing the focusing on the dense particles when separating gray values from the data set.

Figure 4:
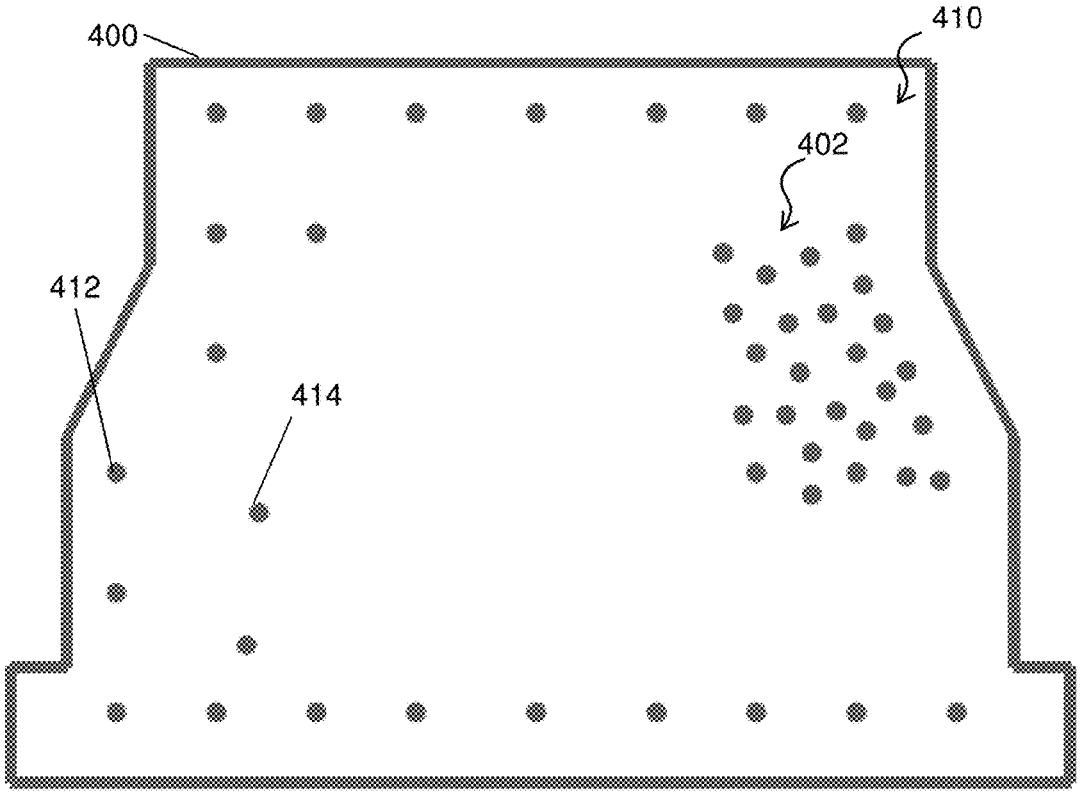
FIG. 4 depicts a modified matrix of dense materials including clustering in a structure in accordance with one or more embodiments.

FIG. 4 depicts a structure 400 comprising a modified matrix of dense materials 410 including clustering 402 in accordance with one or more embodiments. The modified matrix of dense materials 410 includes a plurality of crystal particles 412 distributed in three-dimensional grid, each of which causes scattering of the beam 140 during operations of the beam detection system 100. A portion of the modified matrix of dense materials 410 is located in offset positions, as shown by crystal particle 414. Note that the plurality of crystal particles 412 can be discrete round spheres, as shown by crystal particles 412 and 414, according to one or more embodiments. Grouping of particles, as identified by crystal particle 402 (at least one cluster), can be implemented to distort the view of a sensitive design feature or internal component to an assembly.

Figure 5:
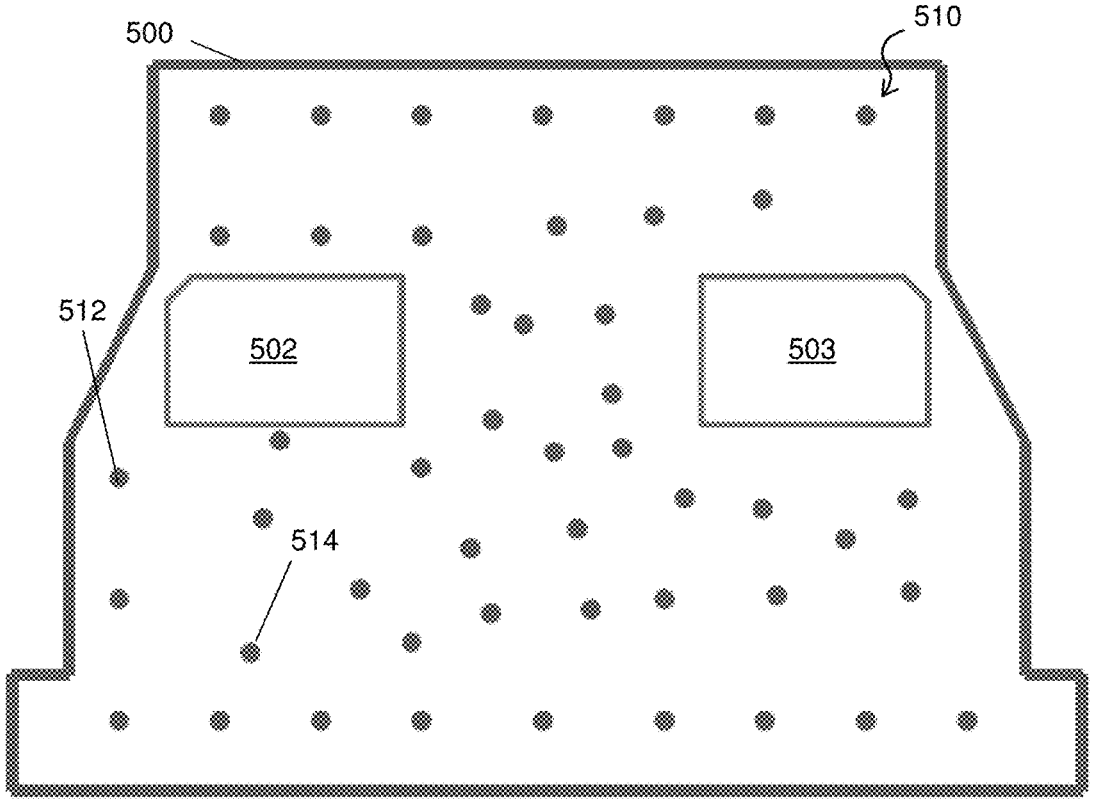
FIG. 5 depicts a modified matrix of dense materials including one or more vacant areas in a structure in accordance with one or more embodiments.

FIG. 5 depicts a structure 500 comprising a modified matrix of dense materials 510 one or more vacant areas 502 and 503 in accordance with one or more embodiments. The modified matrix of dense materials 510 includes a plurality of crystal particles 512 distributed in three-dimensional grid, each of which causes scattering of the beam 140 during operations of the beam detection system 100. A portion of the modified matrix of dense materials 510 is located in offset positions, as shown by crystal particle 514. Note that the plurality of crystal particles 512 can be discrete round spheres, as shown by crystal particles 512 and 514, according to one or more embodiments. The modified matrix of dense materials 510 can include no particles, as indicated by vacant area 502, near the sensitive component so that the sensitive component can be visible with its location (e.g., scanning can reveal the internal part). The modified matrix of dense materials 510 can include no particles, as indicated by vacant area 503, as a red-herring to mislead a scan and analysis.

Figure 6:
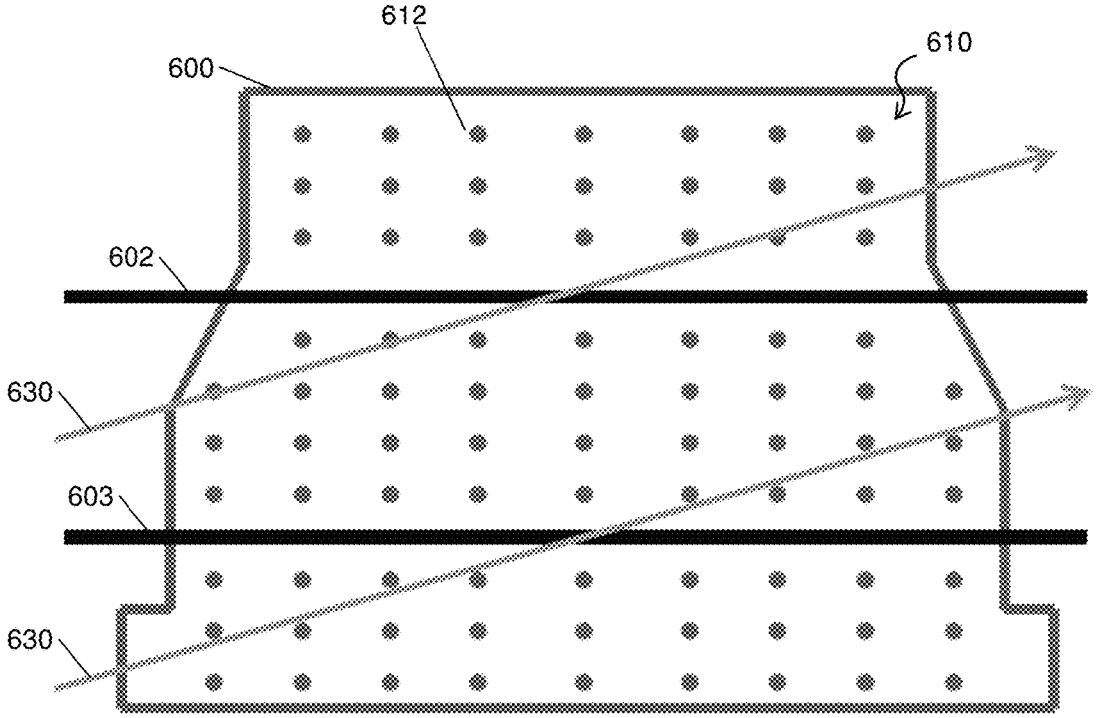
FIG. 6 depicts a modified matrix of dense materials including one or more gaps in a structure in accordance with one or more embodiments.

FIG. 6 depicts a structure 600 comprising a modified matrix of dense materials 610 including one or more gaps 602 and 603 in accordance with one or more embodiments. The modified matrix of dense materials 610 includes a plurality of crystal particles 612 distributed in three-dimensional grid, each of which causes scattering of the beam 140 during operations of the beam detection system 100. In one or more embodiments, the operations of the beam detection system 100 can include a highly collimated fan beam and collimated linear diode array to penetrate the structure 600 unabated with respect to the one or more gaps 602 and 603 to enable geometric dimensioning and tolerancing measurements and inspection of critical areas of the structure 600. For example, the plurality of crystal particles 612 enabled an x-ray inspection performed at an angle 630.

In a non-limiting embodiment, the network or the matrix of dense particles can include one or more of any of the features described with respect to FIGS. 2-6. For example, the network or the matrix of dense particles can include offset positions within a uniform matrix and included clustering, one or more vacant areas, and one or more gaps.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A structure for preventing a scan by a beam, the structure comprising:

a primary material forming the structure, the primary material comprising a first mass attenuation coefficient enabling the primary material to be penetrated by the beam; and a matrix of particles within the primary material to provide scattering or attenuating of the beam to distort the scan, wherein the particles comprise one or more secondary materials different than the primary material, wherein the one or more secondary materials comprises a plurality of crystal particles distributed in three-dimensional modified matrix with a varying number of the plurality of crystal particles located in offset positions and with a varying number of grouped particles, a subset of the plurality of crystal particles comprising oblong shaped crystal particles, and a second subset of the plurality of crystal particles comprises round sphered crystal particles, wherein the one or more secondary materials comprises at least one subsequent mass attenuation coefficient that is greater than the first mass attenuation coefficient of the primary material, and wherein the at least one subsequent mass attenuation coefficient enables the particles to scatter or attenuate the beam to distort the scan comprising the varying number of the grouped particles being positioned within the structure to prevent a view of a design feature or internal component to the structure by the scan, wherein the matrix of particles comprises one or more gaps to enable geometric dimensioning and tolerancing measurements and inspection of critical areas of the structure, one or more vacant areas that include no particles to reveal a view of a first design feature of the structure, one or more secondary materials located in at least one cluster implemented to distort a view of a second design feature of the structure, and one or more vacant areas that include no particles to mislead a scan and analysis of the view of the first and second design features.

2. The structure of claim 1, wherein the primary material comprises aluminum and the one or more secondary materials comprises tungsten, copper, nickel, or iron.

3. The structure of claim 1, wherein the matrix of particles is uniform.

4. The structure of claim 1, wherein the matrix of particles comprises one or more secondary materials located in offset positions.

5. The structure of claim 1 comprises a component, a part, or a tool utilized in an electro-mechanical system of an aircraft.

6. The structure of claim 1, wherein the primary material is layered via additive manufacturing technologies to form the structure.

7. The structure of claim 1, wherein the primary material is produced via casting technologies to form the structure.

* * * * *